US009125245B2

(12) United States Patent
Armstrong et al.

(10) Patent No.: US 9,125,245 B2
(45) Date of Patent: Sep. 1, 2015

(54) MICROWAVE APPLIANCES AND METHODS FOR OPERATING THE SAME

(71) Applicant: General Electric Company, Schenectady, NY (US)

(72) Inventors: James Lee Armstrong, Louisville, KY (US); Joshua Stephen Wiseman, Elizabethtown, KY (US); James Tomaszewski, Louisville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 14/059,726

(22) Filed: Oct. 22, 2013

(65) Prior Publication Data

US 2015/0108119 A1 Apr. 23, 2015

(51) Int. Cl.
*H05B 6/68* (2006.01)
*H05B 6/64* (2006.01)

(52) U.S. Cl.
CPC ..... *H05B 6/6447* (2013.01); *H05B 6/6423* (2013.01)

(58) Field of Classification Search
CPC ..... F24C 15/2007; F24C 15/2042; H05B 6/6438; H05B 6/688
USPC ..... 219/720, 719, 735, 756, 757, 704, 710, 219/712, 716, 770; 99/473, 474
See application file for complete search history.

(56) References Cited

U.S. PATENT DOCUMENTS

| | | | | | |
|---|---|---|---|---|---|
| 3,735,081 | A * | 5/1973 | Foerstner | 219/714 |
| 4,505,194 | A * | 3/1985 | Bishop et al. | 99/336 |
| 4,692,597 | A * | 9/1987 | Tsuda et al. | 219/492 |
| 4,865,864 | A * | 9/1989 | Rijswijck | 426/520 |
| 6,315,821 | B1 | 11/2001 | Pillion et al. | |
| 7,516,692 | B2 * | 4/2009 | Pirkle et al. | 99/333 |
| 2006/0011622 | A1 * | 1/2006 | Lundstrom et al. | 219/757 |
| 2012/0118169 | A1 * | 5/2012 | Hirano et al. | 99/325 |
| 2013/0174746 | A1 * | 7/2013 | Bach | 99/325 |

FOREIGN PATENT DOCUMENTS

| | | | | |
|---|---|---|---|---|
| JP | 2001087598 A | * | 4/2001 | D06F 58/28 |
| JP | 2006198582 A | * | 8/2006 | |
| JP | 2008076047 A | * | 4/2008 | |
| JP | 2011064391 A | * | 3/2011 | |
| KR | 20010060663 A | | 7/2001 | |

* cited by examiner

*Primary Examiner* — Tu B Hoang
*Assistant Examiner* — Alba Rosario-Aponte
(74) *Attorney, Agent, or Firm* — Dority & Manning, P.A.

(57) ABSTRACT

Microwave appliances and methods for operating microwave appliances are provided. A method includes operating a fan of the microwave appliance in order to draw a flow of air through a circulation conduit of the microwave appliance, measuring an operational characteristic of the fan with a sensor of the microwave appliance during the operating step, and providing an indicator signal when the operational characteristic exceeds a threshold value at the measuring step.

16 Claims, 4 Drawing Sheets

FIG. —1—

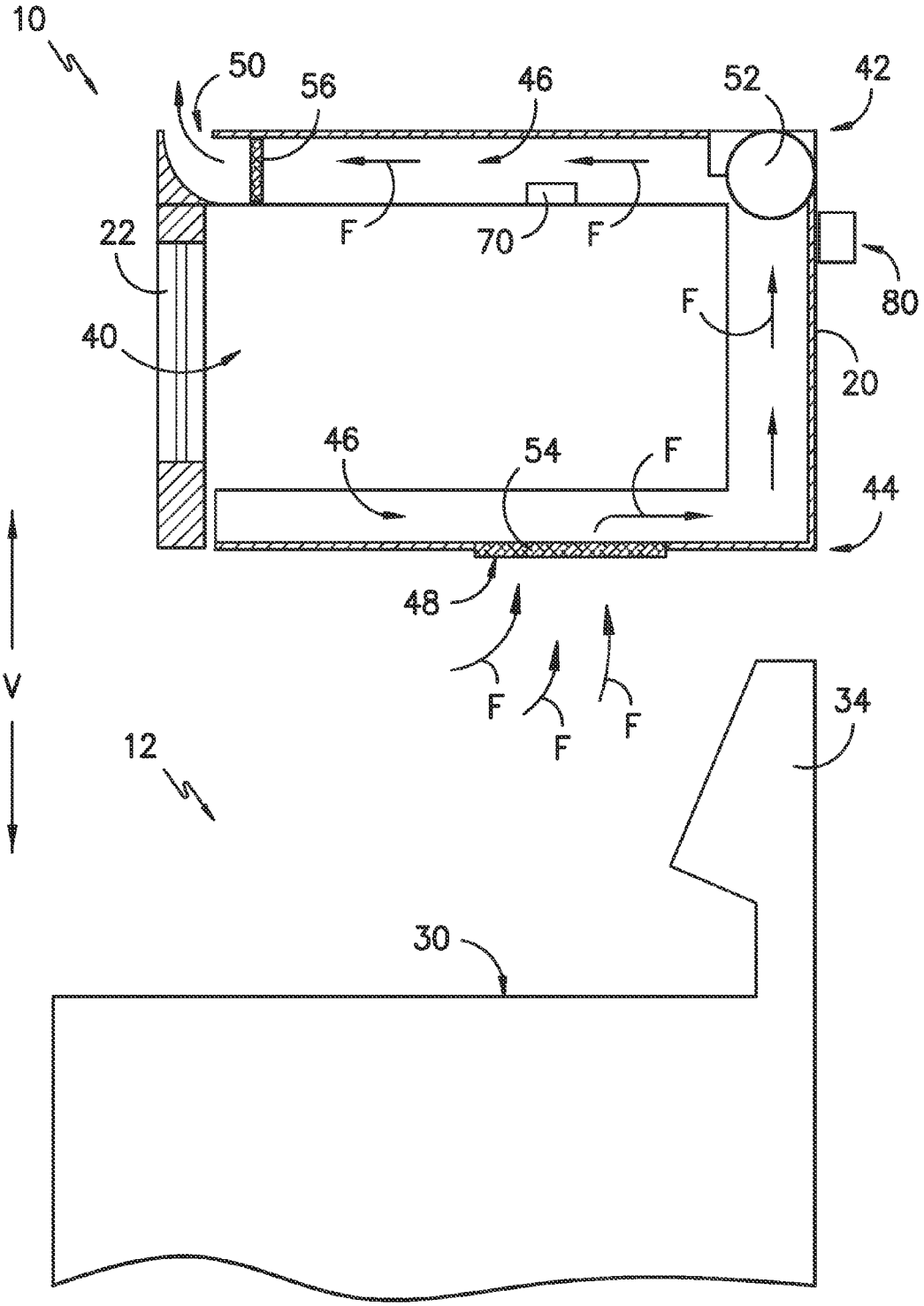
FIG. —3—

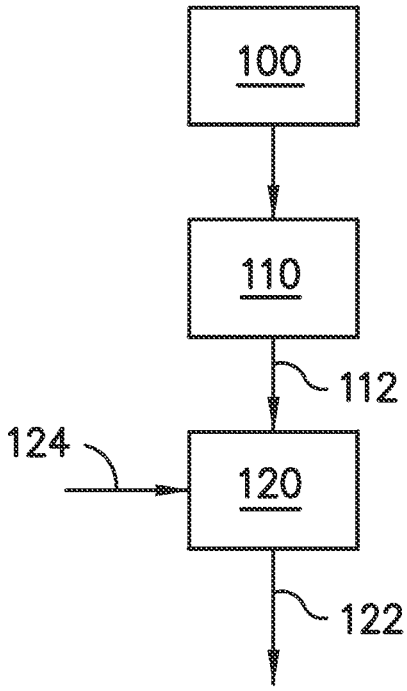
FIG. —4—
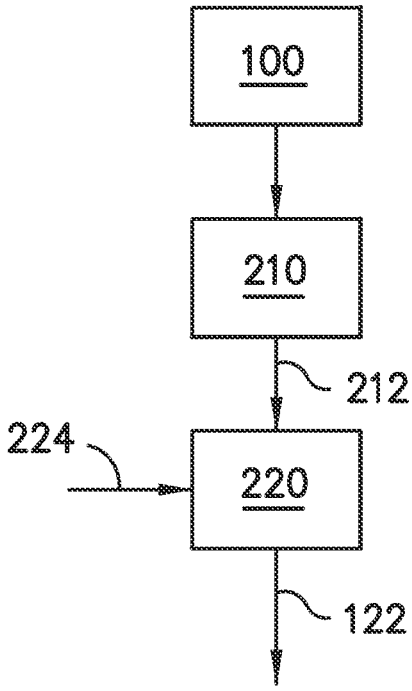
FIG. —5—

MICROWAVE APPLIANCES AND METHODS FOR OPERATING THE SAME

FIELD OF THE INVENTION

The present subject matter relates generally to microwave appliances, such as over-the-range microwave appliances, and methods for operating microwave appliances.

BACKGROUND OF THE INVENTION

Over-the-range microwave appliances are generally mounted above a cooktop of an oven range appliance. In addition to providing for heating of food and beverage items, certain over-the-range microwave appliances include a circulation system. When activated, the circulation system can draw fumes, smoke, grease, and/or steam away from the cooktop of the oven range appliance. Circulation systems generally include a fan for drawing a flow of air into the circulation system and a grease filter for trapping grease entering the circulation system. Certain over-the-range microwave appliances also include air filters for filtering air passing through the microwave appliances' circulation systems. The circulation assembly's air filter can assist with removing dust, particulates, and/or other undesirable substances from air passing therethrough.

Over-the-range microwave appliances generally activate the circulation system's fan on demand and/or for a predetermined time interval in order to filter the air with the circulation system's air filter. After the predetermined time interval elapses, the fan is deactivated and the circulation system stops filtering air. A user can also manually deactivate the fan prior to the predetermined time interval elapsing in order to stop filtering air with the circulation system.

After a period of use, such air filters can require changing. For example, charcoal air filters fill with odor molecules, etc., during use and eventually will cease filtering. Currently, however, consumers do not receive any feedback that the air filter may require changing. Thus, some consumers leave the air filter in for too long or neglect to change the air filter at all, while others change the air filter too soon.

Accordingly, a microwave appliance with features for indicating a need for an air filter change would be desired. In particular, a microwave appliance with features that reduce the risk of prolonged air filter use would be advantageous.

BRIEF DESCRIPTION OF THE INVENTION

In a first exemplary embodiment, a microwave appliance is provided. The microwave appliance includes a casing that defines a chamber configured for receipt of food items for cooking and a circulation conduit. The circulation conduit has an inlet and an outlet. A door is mounted to the casing and is configured for permitting selective access to the chamber of the casing. A fan is positioned within the circulation conduit of the casing. The fan draws a flow of air into the circulation conduit through the inlet of the circulation conduit when the fan is in an activated state. An air filter is mounted to the casing such that the flow of air within the circulation conduit passes through the air filter when the fan is in the activated state. A sensor is in operative communication with the fan for measuring an operational characteristic of the fan. A controller is in operative communication with the sensor, and is configured to provide an indicator signal when the operational characteristic exceeds a threshold value.

In a second exemplary embodiment, a method of operating a microwave appliance is provided. The method includes operating a fan of the microwave appliance in order to draw a flow of air through a circulation conduit of the microwave appliance, measuring an operational characteristic of the fan with a sensor of the microwave appliance during the operating step, and providing an indicator signal when the operational characteristic exceeds a threshold value at the measuring step.

In a third exemplary embodiment, a microwave appliance is provided. The microwave appliance includes a casing that defines a chamber configured for receipt of food items for cooking and a circulation conduit. The circulation conduit has an inlet and an outlet. A door is mounted to the casing and is configured for permitting selective access to the chamber of the casing. A fan is positioned within the circulation conduit of the casing. The fan draws a flow of air into the circulation conduit through the inlet of the circulation conduit when the fan is in an activated state. An air filter is mounted to the casing such that the flow of air within the circulation conduit passes through the air filter when the fan is in the activated state. The microwave appliance further includes a sensor for measuring a flow characteristic of the flow of air within the circulation conduit. A controller is in operative communication with the sensor, the controller configured to provide an indicator signal when the flow characteristic exceeds a threshold value.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

FIG. 3 provides a side, section view of an exemplary microwave appliance and oven range appliance in accordance with another embodiment of the present disclosure.

FIG. 4 illustrates a method of operating a microwave appliance in accordance with one embodiment of the present subject matter.

FIG. 5 illustrates a method of operating a microwave appliance in accordance with another embodiment of the present subject matter.

DETAILED DESCRIPTION

Figure 1:
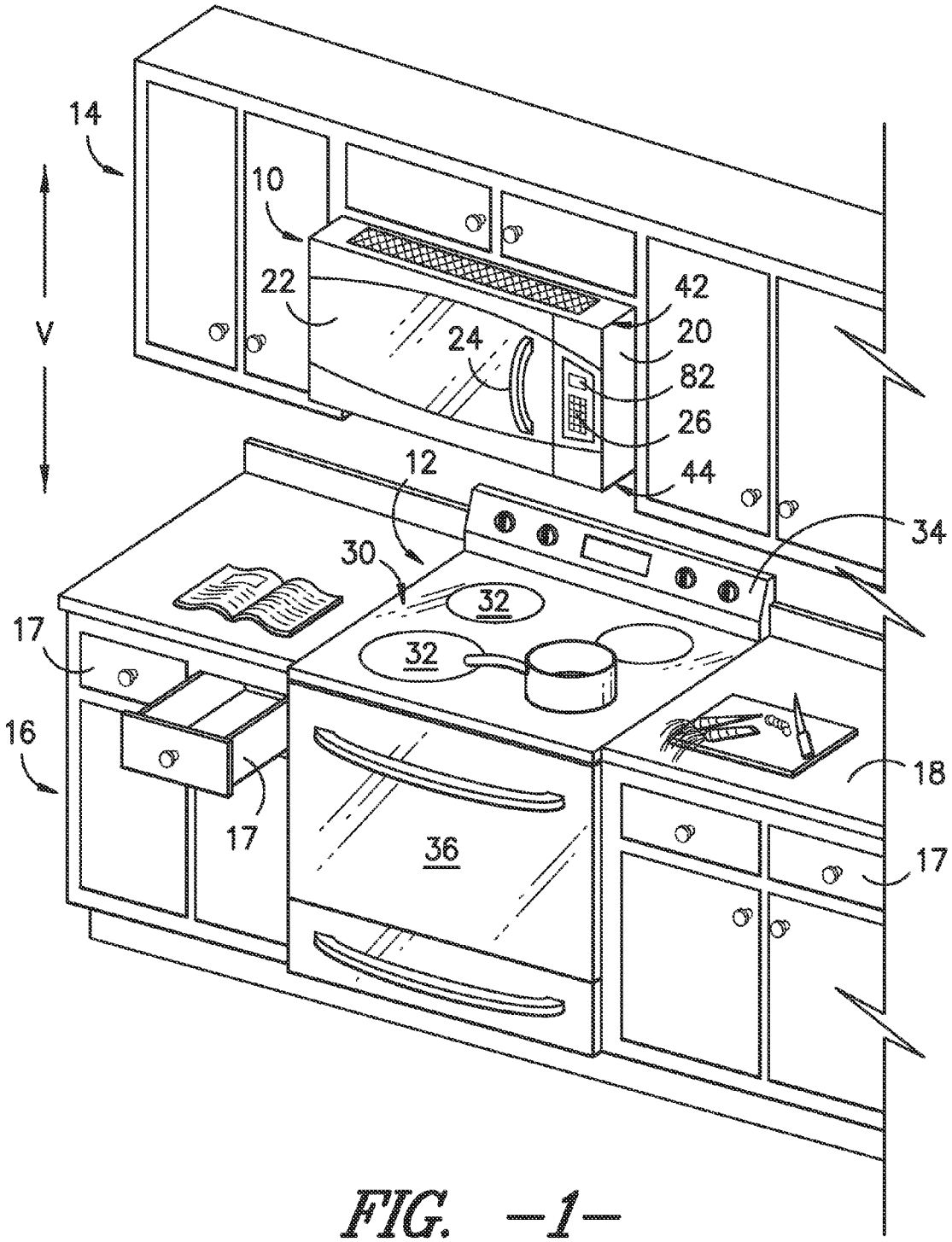
FIG. 1 provides a perspective view of a microwave appliance according to an exemplary embodiment of the present subject matter mounted to a kitchen cabinet above an oven range appliance.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view of a microwave appliance 10 according to an exemplary embodiment of the present subject matter mounted to an upper set of kitchen cabinets 14 above an oven range appliance 12, e.g., along a vertical direction V. Microwave appliance 10 shown in FIG. 1 is commonly referred to as an over-the-range microwave. It should be understood that, in alternative exemplary embodiments, the present subject matter may be used in any other suitable microwave appliance.

As discussed above, microwave appliance 10 is mounted to upper set of kitchen cabinets 14. Upper set of kitchen cabinets 14 is positioned above a base set of kitchen cabinets 16, e.g., along the vertical direction V. Base set of kitchen cabinets 16 includes countertops 18 and drawers 17. Microwave appliance 10 is positioned above base set of kitchen cabinets 16, e.g., along the vertical direction V. Oven range appliance 12 is received within base set of kitchen cabinets 16 below microwave appliance 10. In particular, a cooking surface 30 of oven range appliance 12 is positioned, e.g., directly, below microwave appliance 10 along the vertical direction V. Microwave appliance 10 can include features such as an air handler or fan 52 (FIG. 2) that can draw cooking vapors and/or smoke away from cooking surface 30 and out of the kitchen containing microwave and oven range appliances 10 and 12.

Microwave appliance 10 is configured for receipt of food items for cooking. In particular, microwave appliance 10 includes a cabinet or casing 20 and a door 22 that permits selective access to an interior of microwave appliance 10 and casing 20. Door 22 includes a handle 24 that a user can pull to open door in order to insert food items into microwave appliance 10. Microwave appliance 10 also includes controls 26 that permit a user to make selections for cooking of food items, e.g., a duration of a cooking cycle of microwave appliance 10 and/or a power setting for the cooking cycle of microwave appliance 10.

As discussed above, oven range appliance 12 includes cooking surface 30. Cooking surface 30 includes heated portions 32 that may be heated by heating elements (not shown), e.g., electrical resistive heating elements, gas burners, induction heating elements, and/or any other suitable heating element of combination of heating elements. Oven range appliance 12 also includes a door 36 that permits access to a heated compartment (not shown) of oven range appliance 12, e.g., for cooking or baking of food items therein. A control panel 34 of oven range appliance 12 can permit a user to make selections for cooking of food items, e.g., a duration of a cooking cycle of oven range appliance 12 and/or a power setting for the cooking cycle of oven range appliance 12.

Figure 2:
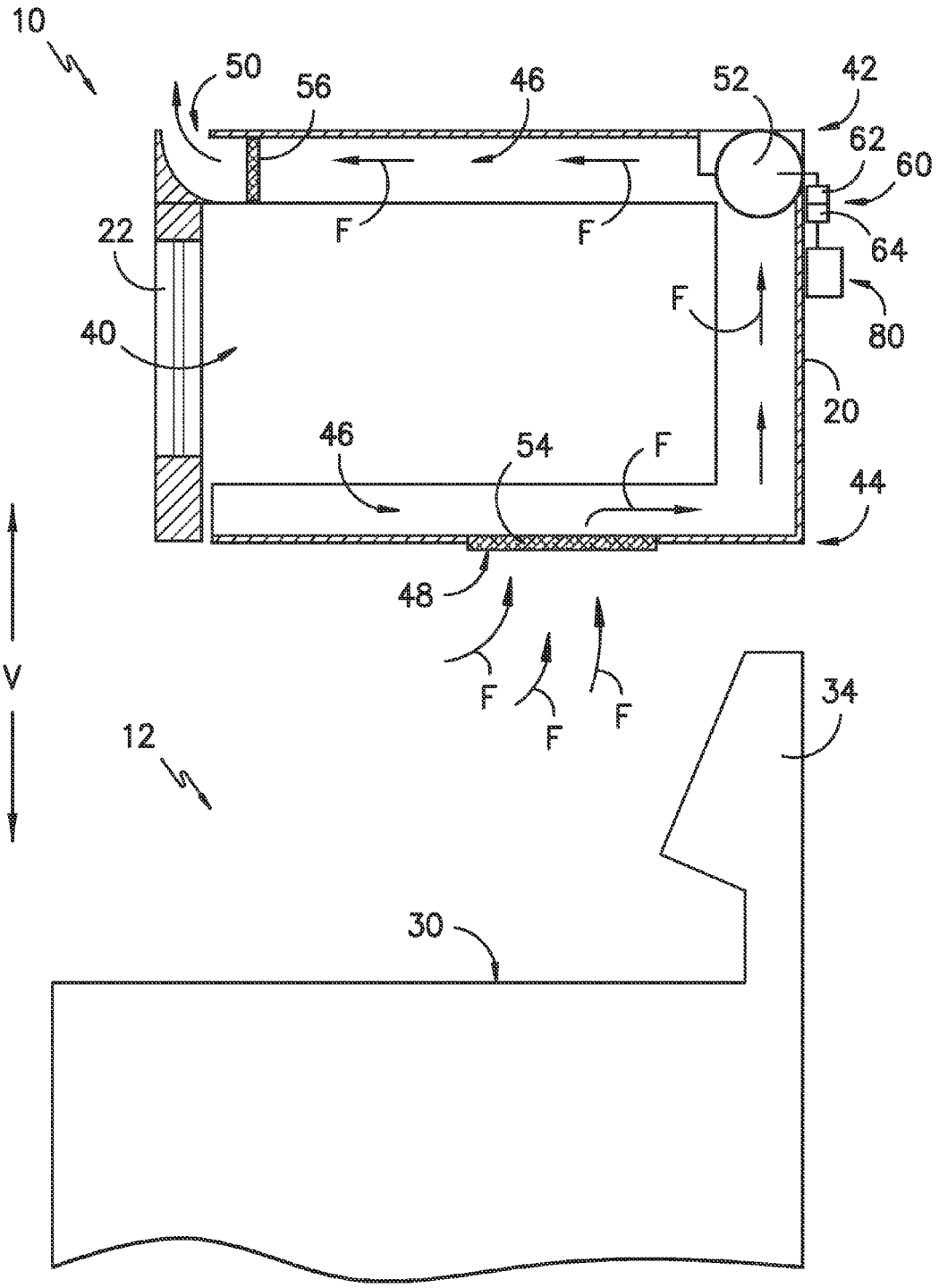
FIG. 2 provides a side, section view of an exemplary microwave appliance and oven range appliance in accordance with one embodiment of the present disclosure.

FIGS. 2 and 3 provide side, section views of microwave appliance 10 and oven range appliance 12. As illustrated, casing 20 extends between a top portion 42 and a bottom portion 44, e.g., along the vertical direction V. Thus, top and bottom portions 42 and 44 of casing 20 are spaced apart from each other, e.g., along the vertical direction V. Casing 20 defines a cooking chamber 40 configured for receipt of food items for cooking. Door 22 of microwave appliance 10 permits selective access to cooking chamber 40 of casing 20. In particular, door 22 of microwave appliance 10 is selectively adjustable between an open position (not shown) and a closed position (FIGS. 1 and 2). In the closed position, door 22 of microwave appliance 10 hinders access to cooking chamber 40 of casing 20. Conversely, door 22 of microwave appliance 10 permits access to cooking chamber 40 of casing 20 in the open position. A user can pull on handle 24 of door 22 of microwave appliance 10 in order to shift door 22 from the closed position shown in FIG. 2 to the open position.

Casing 20 also defines a circulation passage or conduit 46. Circulation conduit 46 has an inlet 48 and an outlet 50. Circulation conduit 46 extends between inlet 48 and outlet 50. Inlet 48 of circulation conduit 46 is positioned at or adjacent bottom portion 44 of casing 20, e.g., such that inlet 48 of circulation conduit 46 faces cooking surface 30 of oven range appliance 12. Conversely, outlet 50 of circulation conduit 46 is positioned at or adjacent top portion 42 of casing 20, e.g., such that outlet 50 of circulation assembly 46 faces away from cooking surface 30 of oven range appliance 12. Thus, inlet 48 and outlet 50 of circulation conduit 46 are spaced apart from each other, e.g., along the vertical direction V.

Microwave appliance 10 also includes a fan 52, such as an axial fan or a radial fan. Fan 52 is positioned within or adjacent circulation conduit 46. Fan 52 draws or urges a flow of air (shown with arrows F) through circulation conduit 46 when fan 52 is in an activated state. Conversely, fan 52 does not draw or urge flow of air F through circulation conduit 46 when fan 52 is in a deactivated state. When fan 52 is in the activated state, flow of air F enters circulation conduit 46 at or through inlet 48 of circulation conduit 46. Flow of air F is directed through circulation conduit 46 to outlet 50, and flow of air F can exit circulation conduit 46 at outlet 50 of circulation conduit 46.

A grease filter 54 is positioned within circulation conduit 46. In particular, grease filter 54 is positioned at or adjacent inlet 48 of circulation conduit 46. Grease filter 54 can assist with removing or filtering grease or other large particles from flow of air F when flow of air F passes through grease filter 54 at inlet 48 of circulation conduit 46. Grease filter 54 may be constructed with an aluminum mesh or a baffle assembly.

Microwave appliance 10 also includes an air filter 56. Air filter 56 is mounted to casing 20 such that flow of air F within circulation conduit 46 passes through air filter 56 when fan 52 is in the activated state. In exemplary embodiments as illustrated, air filter 56 is positioned within circulation conduit 46 at outlet 50 of circulation conduit 46. It should be understood that in alternative exemplary embodiments, air filter 56 may be positioned at any other suitable location on microwave appliance 10.

As illustrated, air filter 56 is positioned downstream of grease filter 54 in flow of air F. In such a manner, grease filter 54 can filter grease and other large particles from flow of air F before flow of air F passes through air filter 56. Grease filter 54 can improve a lifetime of air filter 56 by removing such contaminants from flow of air F rather than air filter 56. Thus, grease filter 54 can be configured for removing relatively large particles from flow of air F, and air filter 56 can be configured for removing relatively small particles from flow of air F. Air filter 56 can be any suitable filter or mechanism for removing particles from flow of air F. For example, air filter 56 may be a charcoal air filter, a high-efficiency particulate air filter, or an electrostatic air filter.

A sensor may be provided for measuring various characteristics of the microwave appliance 10. For example, referring to FIG. 2, a sensor 60 may be in operative communication with the fan 52 for measuring an operational characteristic of the fan 52, such as through a suitable wired or wireless connection. Suitable sensors may be or include, for example, current or voltage sensors or any other suitable sensors or measurement apparatus. Such operational characteristics may be utilized to provide indicator signals when the operational characteristics exceed threshold values. Such threshold values may be predetermined for each operational characteristic. Further, in exemplary embodiments, an indicator signal may be an air filter 56 indicator signal, which may indicate to a consumer that the air filter 56 should be changed. Thus, the operational characteristics of the fan 52 may be correlated to an estimated life of the air filter 56.

In some exemplary embodiments, the sensor 60 may for example be or include a timer 62. For example, an operational characteristic may be a total time that the fan 52 has been in the activated state. The sensor 60 may thus detect and measure every length of time that the fan 52 is activated, such that a total time is measured by the sensor 60. Such time may be measured from, for example, a time of installation of a new air filter 56, and may be reset by the consumer when, for example, a new air filter is installed. In these embodiments, the threshold value may for example be a predetermined time limit for total operation of the fan 52 in the activated state.

In other embodiments, an operational characteristic may be a total time of use of the microwave appliance 10 in general. The sensor 60 may thus detect and measure the total time that the microwave appliance 10, including the fan 52, is installed and capable of operation, such that a total time is measured by the sensor 60. Such time may be measured from, for example, a time of installation of a new microwave appliance 10, and new fan 52, or a new air filter 56, and may be reset by the consumer when, for example, a new microwave appliance, and fan, or air filter is installed. In these embodiments, the threshold value may for example be a predetermined time limit for total time.

In other exemplary embodiments, the sensor 60 may for example be or include a counter 64. For example, an operational characteristic may be a total number of times that the fan 52 has been placed in the activated state. The sensor 60 may thus detect and measure every time that the fan 52 is activated, such that a total number of times is measured by the sensor 60. Such number of times may be measured from, for example, installation of a new air filter 56, and may be reset by the consumer when, for example, a new air filter is installed. In these embodiments, the threshold value may for example be a predetermined limit for total number of times that the fan 52 is placed in the activated state.

In some embodiments, sensor 60 or controller 80 (discussed herein) may further monitor a speed setting of the fan 52. For example, the fan 52 may be operable at various speeds based on user inputs to controls 26, such as low, medium, and high speeds. Operation at a high speed may move the flow of air F through the air filter 56 at a higher velocity than, for example, operation at a medium speed or low speed. Thus, the air filter 56 may require replacement earlier when the fan is 52 is run at higher speeds. Accordingly, sensor 60 or controller may monitor the various speeds at which the fan 52 is operated, and may utilized this information with the operational characteristic information to determine whether a threshold value has been reached. For example, the speed setting may be utilized to increase or decrease operational characteristic information by a predetermined or calculated factor before the operational characteristic information is compared to the associated threshold value.

Referring to FIG. 3, in other embodiments, a sensor 70 may be provided for measuring a flow characteristic of the flow of air F within the circulation conduit 46. Suitable sensors may be or include, for example, revolutions-per-minute ("RPM") sensors, tachometers, or any other suitable sensors or measurement apparatus. The sensor 70 may for example be positioned within the circulation conduit 46, such as downstream (or upstream) of the fan 52, such as in some embodiments between the fan 52 and air filter 56. Such flow characteristics may be utilized to provide indicator signals when the flow characteristics exceed threshold values. Such threshold values may be predetermined for each flow characteristic. Further, in exemplary embodiments, an indicator signal may be an air filter 56 indicator signal, which may indicate to a consumer that the air filter 56 should be changed. Thus, the flow characteristics may be correlated to an estimated life of the air filter 56.

For example, in some embodiments, a flow characteristic may be pressure, such as the pressure of the flow of air F. Sensor 70 may thus, for example, be a pressure sensor. When the pressure of the flow of air F drops beyond a certain predetermined threshold value, this may indicate that the air filter 56 is clogged to a certain extent and may require replacing.

In other embodiments, a flow characteristic may be force, such as the force of the flow of air F. Sensor 80 may thus, for example, be a sail switch. When the force of the flow of air F past the sail switch drops beyond a certain predetermined threshold, this may cause the switch to activate and indicate that the air filter 56 is closed to a certain extent and may require replacing.

As may be seen in FIGS. 2 and 3, microwave appliance 10 may further include a controller 80. Operation of microwave appliance 10 may be regulated by controller 80. Controller 80 is operatively coupled or in communication with various components of microwave appliance 10, including controls 26. In response to user manipulation of controls 26, controller 80 operates the various components of microwave appliance 10 to execute selected cycles and features.

Controller 80 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 60 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Controls 26 and other components of microwave appliance 10 may be in communication with controller 80 via one or more signal lines or shared communication busses.

Controller 80 may also be in operative communication with fan 52 and sensor 60, 70. Thus, controller 80 can selectively adjust fan 52 between the activated and deactivated states in order to regulate the flow of air F through circulation conduit 46. Further, controller 80 may provide an indicator signal when an operational characteristic or flow characteristic exceeds a threshold value. For example, controller 80 may store the various threshold values and/or receive signals from the sensor 60, 70 regarding the threshold values. Further, controller 80 may receive from the sensor 60, 70 signals based on the operational characteristics and/or flow characteristics, and may compare these signals to the threshold values. Still further, if an operational characteristic or flow characteristic exceeds the associated threshold value, the controller 80 may output an indicator signal. As discussed, the indicator signal may be an air filter 56 change signal, thus indicating that the air filter 56 should be replaced.

In exemplary embodiments, the indicator signal may be output to a controls display 82 of the microwave, which may additionally display information based on user input to controls 26, etc. Alternatively, the indicator signal may be output to a light, which may for example flash or activate when it receives the indicator signal, or may be output to another suitable source.

Referring now to FIGS. 4 and 5, the present disclosure is further directed to methods for operating microwave appliances 10. A method may include, for example, the step 100 of operating a fan 52 of the microwave appliance 10 in order to draw a flow of air F through a circulation conduit 46 of the microwave appliance 10, as discussed above. The method may further include the step 110 of measuring an operational characteristic 112 of the fan 52 with a sensor 60 of the microwave appliance 10, as discussed above. The method may further include the step 120 of providing an indicator signal 122 when the operational characteristic 112 exceeds a threshold value 124 at the measuring step 110, as discussed above.

In some embodiments, a method may further include the step 130 of monitoring a speed setting of the fan 52 with the sensor 60, as discussed above.

Additionally or alternatively, a method may include, for example, the step 210 of measuring a flow characteristic 212 of the flow of air F with a sensor 70 of the microwave appliance 10, as discussed above. The method may further include the step 220 of providing an indicator signal 122 when the flow characteristic 212 exceeds a threshold value 224 at the measuring step 210, as discussed above.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A microwave appliance, comprising:

a magnetron for generating microwaves;

a casing that defines a chamber configured for receipt of food items for cooking and a circulation conduit, the circulation conduit having an inlet and an outlet;

a door mounted to the casing and configured for permitting selective access to the chamber of the casing;

a fan positioned within the circulation conduit of the casing, the fan drawing a flow of air into the circulation conduit through the inlet of the circulation conduit when the fan is in an activated state;

an air filter mounted to the casing such that the flow of air within the circulation conduit passes through the air filter when the fan is in the activated state;

a sensor in operative communication with the fan for measuring an operational characteristic of the fan correlated to an estimated life of the air filter, the operational characteristic including a total time that the fan has been in the activated state and a total number of times that the fan has been placed in the activated state; and a controller in operative communication with the sensor, the controller configured to provide an indicator signal when the operational characteristic exceeds a threshold value.

2. The microwave appliance of claim 1, wherein the total time that the fan has been in the activated state includes every length of time that the fan is activated, and wherein the total number of times that the fan has been placed in the activated state is a measure of every time that the fan is activated.

3. The microwave appliance of claim 1, wherein the total time that the fan has been in the activated state is a measure of every length of time that the fan is activated until reset by a user.

4. The microwave appliance of claim 1, wherein the sensor further monitors a speed setting of the fan.

5. The microwave appliance of claim 1, wherein the indicator signal is an air filter change signal.

6. The microwave appliance of claim 1, wherein the air filter is positioned within the circulation conduit of the casing at the outlet of the circulation conduit.

7. The microwave appliance of claim 1, wherein the air filter comprises a charcoal air filter, a high-efficiency particulate air filter, or an electrostatic air filter.

8. The microwave appliance of claim 1, further comprising a grease filter positioned within the circulation conduit of the casing at the inlet of the circulation conduit, the air filter positioned downstream of the grease filter.

9. A method of operating a microwave appliance, comprising:

operating a fan of the microwave appliance in order to draw a flow of air through a circulation conduit of the microwave appliance, the microwave appliance including a magnetron for generating microwaves;

measuring an operational characteristic of the fan correlated to an estimated life of the air filter with a sensor of the microwave appliance during the operating step; and providing an indicator signal when the operational characteristic exceeds a threshold value at the measuring step;

wherein the operational characteristic includes a total time that the fan has been in the activated state and a total number of times that the fan has been placed in the activated state.

10. The method of claim 9, wherein the total time that the fan has been in the activated state includes every length of time that the fan is activated, and wherein the total number of times that the fan has been placed in the activated state is a measure of every time that the fan is activated.

11. The method of claim 9, wherein total time that the fan has been in the activated state is a measure of every length of time that the fan is activated until reset by a user.

12. The method of claim 9, further comprising monitoring a speed setting of the fan with the sensor.

13. The method of claim 9, wherein the indicator signal is an air filter change signal.

14. The method of claim 9, wherein said step of operating comprises operating the fan of the microwave appliance in order to draw the flow of air through the circulation conduit of the microwave appliance and an air filter of the microwave appliance.

15. A microwave cooking appliance, comprising:

a magnetron for generating microwaves;

a casing that defines a chamber configured for receipt of food items for cooking and a circulation conduit, the circulation conduit having an inlet and an outlet;

a door mounted to the casing and configured for permitting selective access to the chamber of the casing;

a fan positioned within the circulation conduit of the casing, the fan drawing a flow of air into the circulation conduit through the inlet of the circulation conduit when the fan is in an activated state;

an air filter mounted to the casing such that the flow of air within the circulation conduit passes through the air filter when the fan is in the activated state;

a sensor in operative communication with the fan for measuring an operational characteristic of the fan, the operational characteristic of the fan correlating to an estimated life of the air filter and including a total time that the fan has been in the activated state and a total number of times that the fan has been placed in the activated state; and a controller in operative communication with the sensor, the controller configured to provide an indicator signal when the operational characteristic exceeds a threshold value.

16. The microwave cooking appliance of claim 15, wherein the indicator signal is an air filter change signal.

* * * * *